US012473725B2

(12) United States Patent
Lechner et al.

(10) Patent No.: US 12,473,725 B2
(45) Date of Patent: Nov. 18, 2025

(54) MOUNTING DEVICE

(71) Applicant: GEBERIT INTERNATIONAL AG, Jona (CH)

(72) Inventors: Manuel Lechner, Kaltbrunn (CH); Lukas Ramseier, Jona (CH)

(73) Assignee: GEBERIT INTERNATIONAL AG, Jona (CH)

( * ) Notice: Subject to any disclaimer, the term of this patent is extended or adjusted under 35 U.S.C. 154(b) by 76 days.

(21) Appl. No.: 18/266,411

(22) PCT Filed: Dec. 1, 2021

(86) PCT No.: PCT/EP2021/083683
§ 371 (c)(1),
(2) Date: Jun. 9, 2023

(87) PCT Pub. No.: WO2022/122491
PCT Pub. Date: Jun. 16, 2022

(65) Prior Publication Data

US 2024/0035266 A1 Feb. 1, 2024

(30) Foreign Application Priority Data

Dec. 10, 2020 (EP) ..... 20213092
Dec. 10, 2020 (EP) ..... 20213096
Dec. 10, 2020 (EP) ..... 20213098

(51) Int. Cl.
*E03C 1/326* (2006.01)
*E03D 11/14* (2006.01)

(52) U.S. Cl.
CPC ..... *E03C 1/326* (2013.01); *E03D 11/143* (2013.01)

(58) Field of Classification Search
CPC ..... E03D 11/143
See application file for complete search history.

(56) References Cited

U.S. PATENT DOCUMENTS

2005/0211852 A1* 9/2005 Nicolia ..... E03D 11/143 248/68.1
2021/0123225 A1* 4/2021 Bissell ..... E03D 11/143
2021/0310229 A1* 10/2021 Barker ..... E03C 1/328

FOREIGN PATENT DOCUMENTS

CN 101250892 A 8/2008
DE 26 39 018 A1 3/1978
DE 2809135 A1 9/1979
(Continued)

OTHER PUBLICATIONS

Englsi Machine translation printed Jan. 7, 2025.*
(Continued)

*Primary Examiner* — Christine J Skubinna
(74) *Attorney, Agent, or Firm* — Sughrue Mion, PLLC

(57) ABSTRACT

A mounting device (1) for fastening at least one plumbing appliance comprises: two supports (2) which extend at a distance from each other along a central axis (M2) and each of which has a cross section (Q2): a first cross-member (3) which extends along a central axis (M3), has a first cross-section (Q3), is fixedly connected to the supports (2) and connects the two supports (2) to one another and is located at a distance from the first cross-member (3) above the first cross-member (3) when viewed in the mounted position; the cross-section (Q3, Q4) of at least one of the cross members (3, 4) is substantially equal to the cross-section (Q2) of the supports.

20 Claims, 5 Drawing Sheets

(56) References Cited

FOREIGN PATENT DOCUMENTS

| | | | |
|---|---|---|---|
| DE | 3410499 | A1 | 8/1985 |
| DE | 297 04 549 | U1 | 6/1997 |
| DE | 203 04 749 | U1 | 5/2003 |
| DE | 102013203941 | A1 | 9/2014 |
| EP | 0 731 231 | A1 | 9/1996 |
| EP | 0860559 | A1 | 8/1998 |
| EP | 1813733 | A2 | 8/2007 |
| EP | 2 366 838 | A1 | 9/2011 |
| EP | 2 662 502 | A1 | 11/2013 |
| EP | 2921719 | A1 | 9/2015 |
| EP | 3 470 587 | A1 | 4/2019 |
| EP | 3 670 772 | A1 | 6/2020 |
| RU | 21790 | U1 | 2/2002 |
| WO | 2015/180963 | A1 | 12/2015 |

OTHER PUBLICATIONS

English Machine translation printed Jan. 7, 2025.*
International Search Report of PCT/EP2021/083685 dated Mar. 14, 2022 [PCT/ISA/210].
International Search Report for PCT/EP2021/083684 dated Mar. 14, 2022.
Written Opinion for PCT/EP2021/083684 dated Mar. 14, 2022.
Written Opinion issued Mar. 14, 2022 in Application No. PCT/EP2021/083685.
Written Opinion issued Mar. 14, 2022 in Application No. PCT/EP2021/083683.
International Search Report for PCT/EP2021/083683 dated Mar. 18, 2022 [PCT/ISA/210].

* cited by examiner

MOUNTING DEVICE

CROSS REFERENCE TO RELATED APPLICATIONS

This application is a National Stage of International Application No. PCT/EP2021/083683 filed Dec. 1, 2021, claiming priorities based on European Patent Application No. 20213092.8 filed Dec. 10, 2020, European Patent Application No. 20213098.5 filed Dec. 10, 2020, European Patent Application No. 20213096.9 filed Dec. 10, 2020.

TECHNICAL FIELD

The present invention relates to a mounting device for attaching at least one sanitary fixture according to the preamble of claim 1.

PRIOR ART

Mounting devices for attaching sanitary fixtures are known from the prior art. Mounting devices of this type are installed securely behind a pre-wall and serve to bear sanitary fixtures, such as cisterns, toilet bowls, urinals, faucets, sinks, control elements, electric elements, etc. For example, EP 2 662 502 discloses a mounting device of this type.

Although mounting devices from the prior art achieve very good results when mounted in a building, it is desirable, from a manufacturer's perspective, to simplify manufacture. Many of the known mounting devices are very complex to manufacture.

SUMMARY OF THE INVENTION

Starting from this prior art, the object of the present invention is to lay down a mounting device for attaching at least one sanitary fixture which overcomes the disadvantages of the prior art. In particular, it is an object of the present invention to lay down a mounting device for attaching at least one sanitary fixture which is simpler or more efficient to manufacture.

This object is achieved by the subject matter of claim 1. Accordingly, a mounting device comprises two supports, which run at a distance from one another, each extend along a central axis and each have a support cross section, a first cross-member, which extends along a central axis, has a cross-member cross section, is securely connected to the supports and connects the supports to one another, and a second cross-member, which extends along a central axis, has a cross-member cross section, is securely connected to the supports and connects the supports to one another. The second cross-member is arranged at a distance from the first cross-member and, when viewed in the installation position, above the first cross-member. The cross-member cross section of at least one of the aforementioned cross-members is substantially identical to or identical to or the same as the support cross section of the supports.

Configuring the at least one cross-member with a cross section configured to be identical to the cross section of the support has the advantage of simplifying the manufacture of a mounting device of this type. If said at least one cross-member and the supports are manufactured by means of a metal-forming process, then said at least one cross-member and the supports can be manufactured on the same production line without requiring further conversion, thereby optimizing manufacture. If said at least one cross-member and the supports are manufactured from prefabricated profiles, then storage can be optimized, since the number of profiles to be stored is reduced.

A further advantage is obtained by connecting the supports with the at least one cross-member with an identical cross section. The identical cross section enables the cross-member and support to be positioned on a planar surface. Consequently, the at least one cross-member and the supports are already lying in the correct plane, thus dispensing with an alignment procedure relative to said surface.

A further advantage is obtained with respect to the increased stability of the mounting device. The identical cross section enables the installation space between a front plane defined by the front faces of the support, and a rear plane defined by the rear faces of the support to be fully utilized by the at least one cross-member. This makes it possible to maximize the cross section of the cross-member, which is advantageous for absorbing various mechanical loads.

The wording "a substantially identical cross section" is understood to mean that the cross sections of the respective supports or the at least one cross-member are the same as or match or one another, irrespective of any possible openings in the walls of the supports or cross-members. Openings of this type serve to attach and/or position sanitary fixtures.

The cross section of the cross-member is defined as the section transverse to the central axis of the cross-member. The cross section of the supports is defined as the section transverse to the central axis of the supports.

Preferably, said at least one cross-member and the two supports each have an identical cross section over the entire length thereof, irrespective of the above-mentioned openings.

In the installation position, the supports run in the vertical or plumb-line direction and the cross-members run in the horizontal direction, i.e., substantially transverse to the plumb-line direction. The supports can therefore be referred to as vertical supports.

Preferably, the cross-member and support cross sections which are configured to be identical to one another are identical with regard to cross-sectional geometry and/or cross-sectional area. In other words, the cross-member cross section of said at least one cross-member is configured to be identical to the support cross section with regard to cross-sectional geometry and/or cross-sectional area.

Preferably, the outer cross section of the supports and the at least one cross-member is in each case identical to the cross-member and support cross sections which are configured to be identical to one another. The wording "outer cross section" is understood to mean the outer shape of the cross-member or the cross-member.

Preferably, the supports and said at least one cross-member are provided by way of a hollow profile, wherein the outer cross section and the inner cross section of the support and the at least one cross-member are in each case identical to the support and cross-member cross sections which are configured to be identical to one another. The wording "outer cross section" is understood to mean the outer shape of the cross-member or the cross-member and the wording "inner cross section" is understood to mean the cross-sectional shape of the cavity.

Preferably, the outer cross section and/or the inner cross section each have a rectangular, in particular square, shape.

Preferably, the cross-member cross section of the first cross-member is identical to the support cross section, and the cross-member cross section of the second cross-member differs from the support cross section. The cross sections of the two cross-members therefore differ from one another.

Owing to the mounted sanitary fixture, the lower cross-member, here the first cross-member, is subjected to compression and the upper cross-member, here the second cross-member, is subjected to tension. The difference in configuration brings about the advantage that each cross-member can be optimally configured with respect to the load thereon.

Preferably, the support and the at least one cross-member with cross-member and support cross sections which are configured to be identical to one another are provided by way of a square tube, in particular a welded square tube.

A square tube has the advantage that the forces arising from the sanitary fixture can be transferred effectively into the mounting device.

Preferably, the wall thickness of the at least one cross-member and the supports is between 1 and 8 mm, in particular between 1.5 and 3 mm.

Preferably, the width and/or height of the cross-member cross section of the at least one cross-member, and of the support cross section of each support is in the region of from 30 to 50 mm, in particular between 35 and 45 mm. The width and height are in this case the dimensions of extent of the at least one cross-member or support in a direction transverse to the central axis.

Preferably, the second cross-member comprises at least one attachment element, via which the sanitary fixture can be attached to the mounting device. Preferably, the at least one attachment element serves to receive a threaded rod which projects substantially perpendicularly relative to the frame and to the support and can be brought into contact with the sanitary fixture. In order to receive the threaded rod, the attachment element has a corresponding internal thread.

Preferably, the leading face of the supports define a front plane and the trailing face of the supports define a rear plane, wherein the at least one cross-member is arranged in such a way that it lies between the front plane and the rear plane. In particular, the cross-member with a cross section identical to the cross section of the support is arranged in such a way that it lies between the front plane and the rear plane. Other cross-members may also penetrate the rear plane and/or the front plane.

Preferably, the supports and cross-members are made of steel.

Preferably, the two supports are configured so as to be the same as one another. In particular, the two supports have an identical cross section.

Preferably, the ends of each of the two cross-members are securely connected to the supports via a welded joint.

Preferably, each of the supports is connected to a support foot, via which the mounting device stands on a floor, wherein the support foot is preferably configured so as to be displaceable relative to the support and lockable relative to the support.

Preferably, the supports are connected, in addition to said cross-members, to a third cross-member, which is preferably arranged at the upper end of the support.

According to a method for manufacturing a mounting device according to the above description, the supports and cross-member with an identical support or cross-member cross section are manufactured by way of a metal-forming procedure and a subsequent welding procedure. The identical cross section enables the supports and cross-member with an identical support or cross-member cross section to be manufactured on the same machine without resetting.

The tube cross section itself is formed in the metal-forming procedure and the resulting gap is closed in the welding procedure. Preferably, a laser welding method is used.

Preferably, prior to the metal-forming procedure, a metal sheet is provided in the dimensions of the development of the profile about the central axis and the profile length for each of the supports and the cross-member with an identical support or cross-member cross section.

Preferably, prior to the metal-forming procedure, the metal sheet is provided with openings by way of a punching procedure.

Further embodiments are laid down in the dependent claims.

BRIEF DESCRIPTION OF THE DRAWINGS

Preferred embodiments of the invention are described in the following with reference to the drawings, which are provided for illustrative purposes only and are not to be interpreted as restrictive. In the drawings.

DESCRIPTION OF PREFERRED EMBODIMENTS

Figure 1:
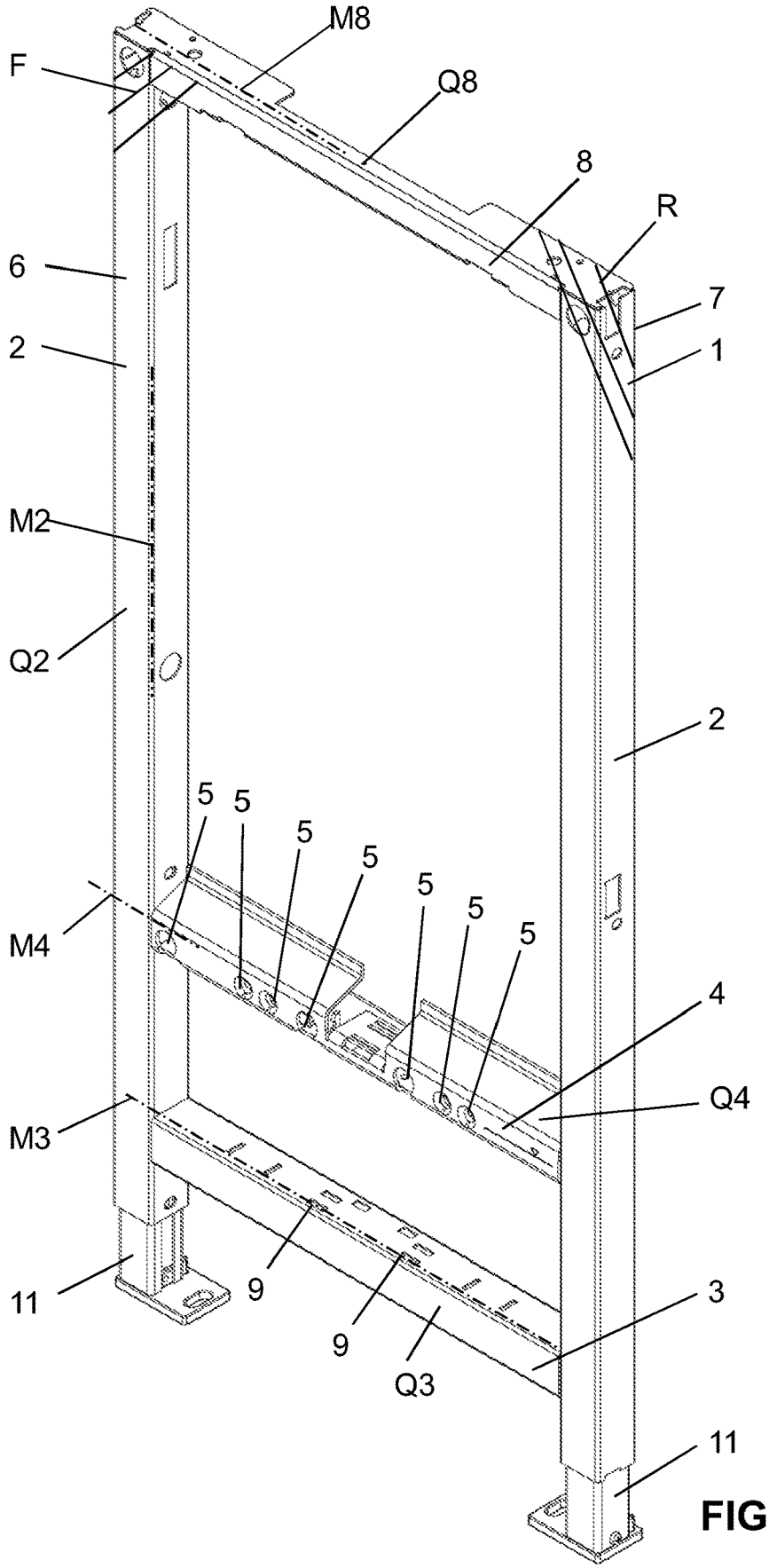
FIG. 1 shows a perspective view of an embodiment of a mounting device of the present invention.

The figures show an embodiment of a mounting device 1 for attaching at least one sanitary fixture. The mounting device 1 is in this case connected securely to a building and the sanitary fixtures are subsequently attached to the mounting device. The mounting device 1 is typically located behind a pre-wall. Mounted in front of the pre-wall are the sanitary fixtures with which the user directly interacts, such as a toilet bowl, urinal or sink. Mounted behind the pre-wall are the sanitary fixtures to which the user does not require direct access, such as a cistern, water supply pipes and wastewater pipes.

The mounting device 1 comprises two supports 2 which run at a distance from one another and each extend along a central axis M2. Furthermore, the supports 2 each have a support cross section Q2. Furthermore, the mounting device 1 comprises a first cross-member 3 and a second cross-member 4. The first cross-member 3 extends along a central axis M3 and has a cross-member cross section Q3. The second cross-member 4 extends along a central axis M4 and has a cross-member cross section Q4. Both cross-members are securely connected at the ends thereof to the supports 2 and thus connect the supports 2 to one another. Preferably, the two cross-members 3, 4 are connected to the supports 2 via a welded joint. In the installation position, the supports 2 run in the vertical direction and the cross-members 3, 4 run in the horizontal direction.

At the top, the mounting device 1 has an optional third cross-member 8. In this case, the third cross-member 8 is arranged at the ends of the two supports 2. The cross-members 3, 4 and 8 are connected to the supports via welded joints. In the embodiment shown, the second cross-member 4 is arranged at a distance from the first cross-member 3 and, in the installation position, as shown in the figures, is located above the first cross-member 3.

The cross-member cross section Q3, Q4 of at least one of the aforementioned cross-members 3, 4 is configured to be substantially identical to the support cross section Q2. In the embodiment shown, the cross-member cross section Q3 of the cross-member 3 is configured to be identical to the support cross section Q2, while the cross-member cross section Q4 of the second cross-member 4 has a different cross section. The third cross-member 8 also has a different cross section Q8. In other embodiments, it is also conceivable for all cross-members to likewise have a cross section identical to the supports 2.

Figure 2:
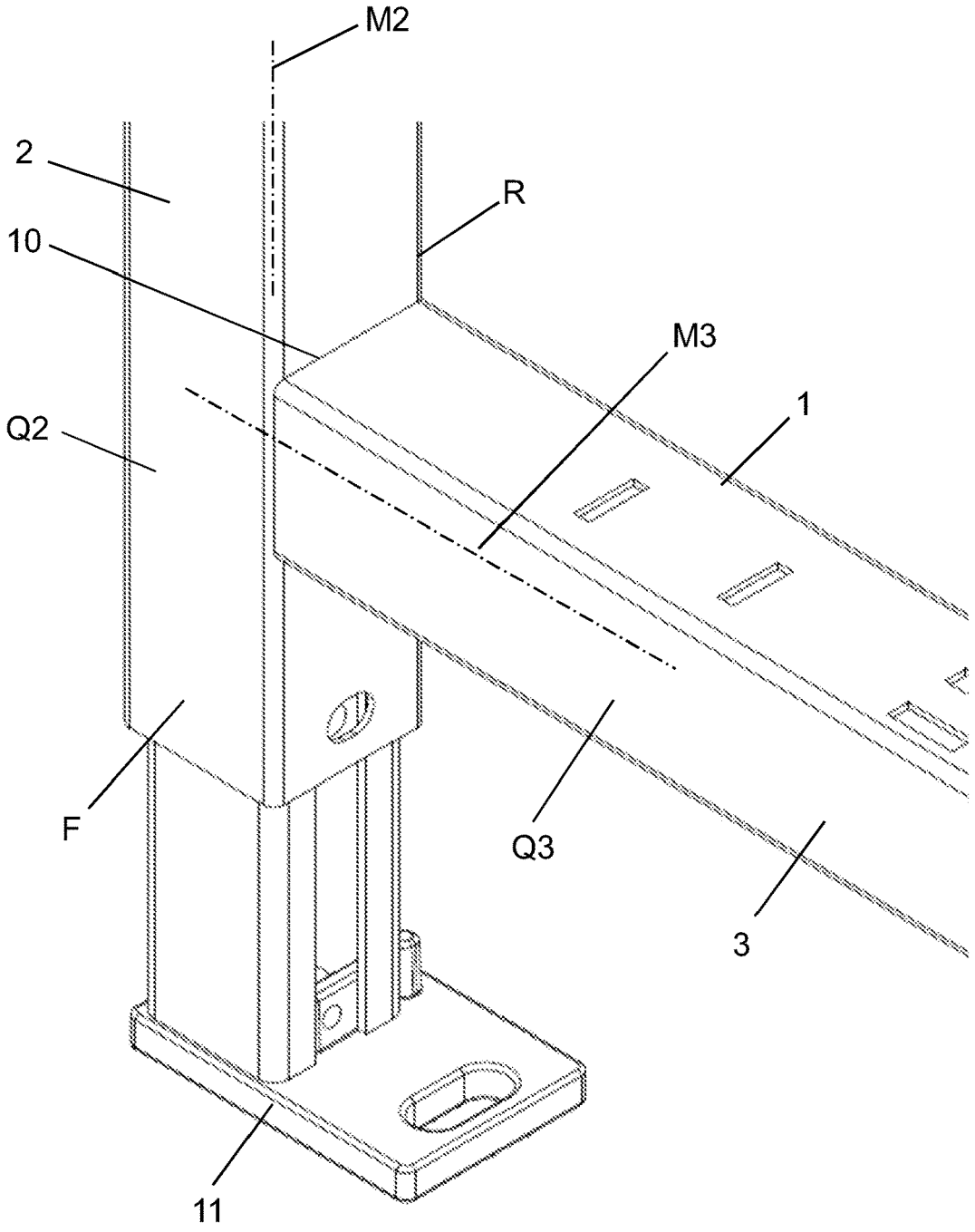
FIG. 2 shows a detail view of the mounting device according to FIG. 1.

FIG. 2 shows a detail view of FIG. 1, in which the detail view is limited to the connection point 10 between the first cross-member 3 and the support 2. This detail view clearly illustrates that the outer cross section of the support 2 and the outer cross section of said cross-member 3 are identical in each case.

Figure 3:
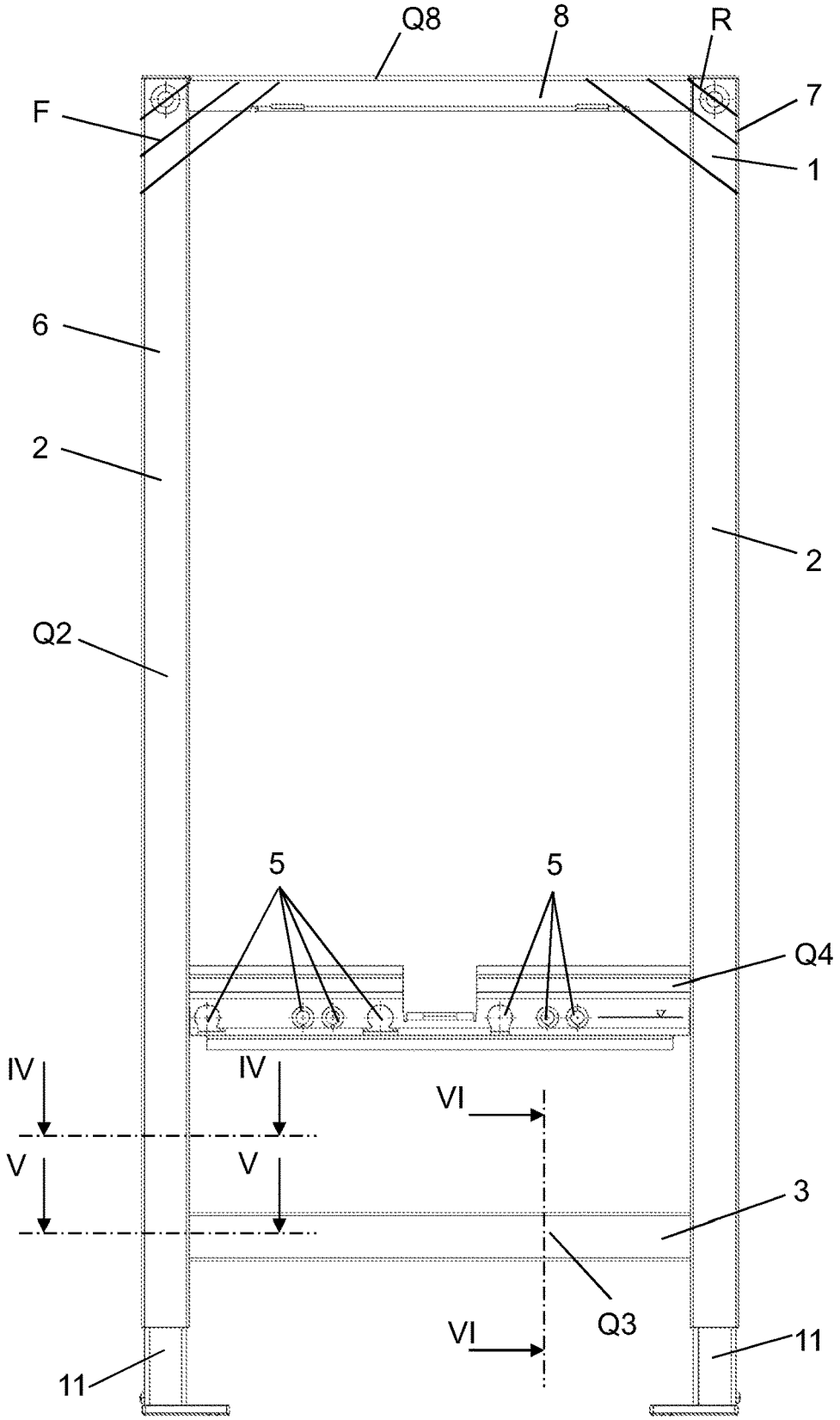
FIG. 3 shows a front view of the mounting device according to FIG. 1.
Figure 4:
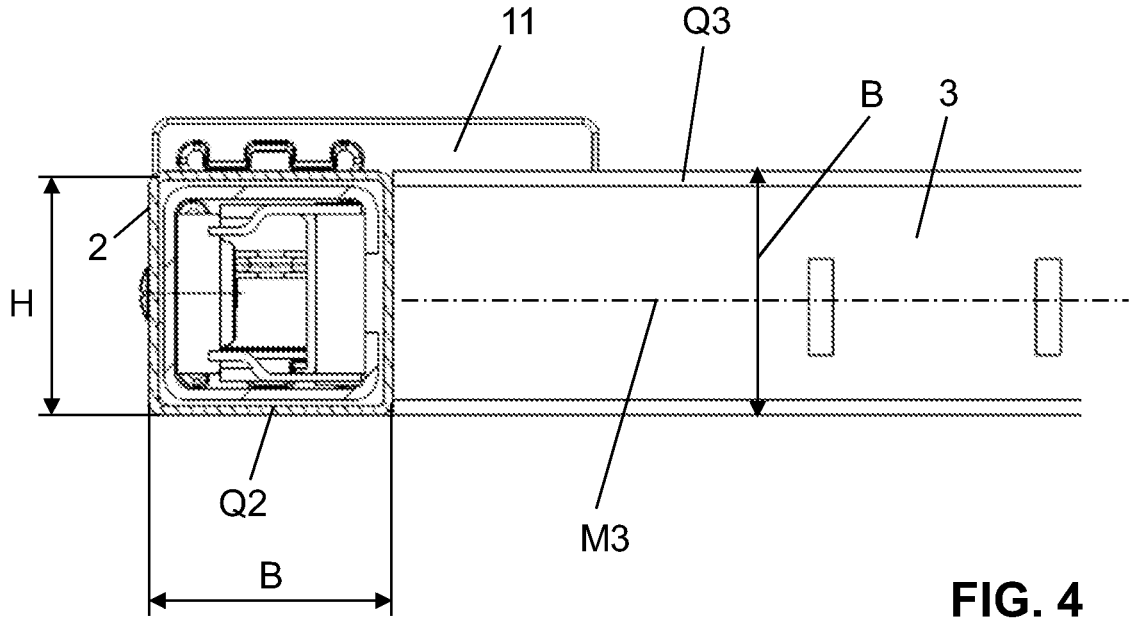
FIG. 4 shows a sectional view along the line of intersection IV-IV in FIG. 3.
Figure 5:
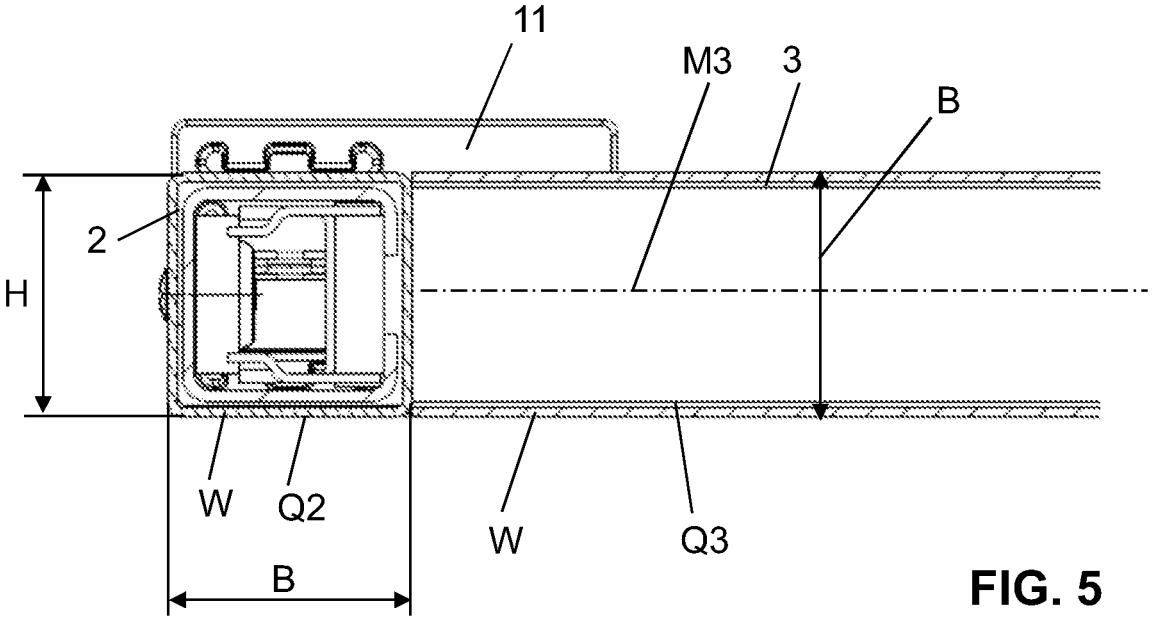
FIG. 5 shows a sectional view along the line of intersection V-V in FIG. 3.
Figure 6:
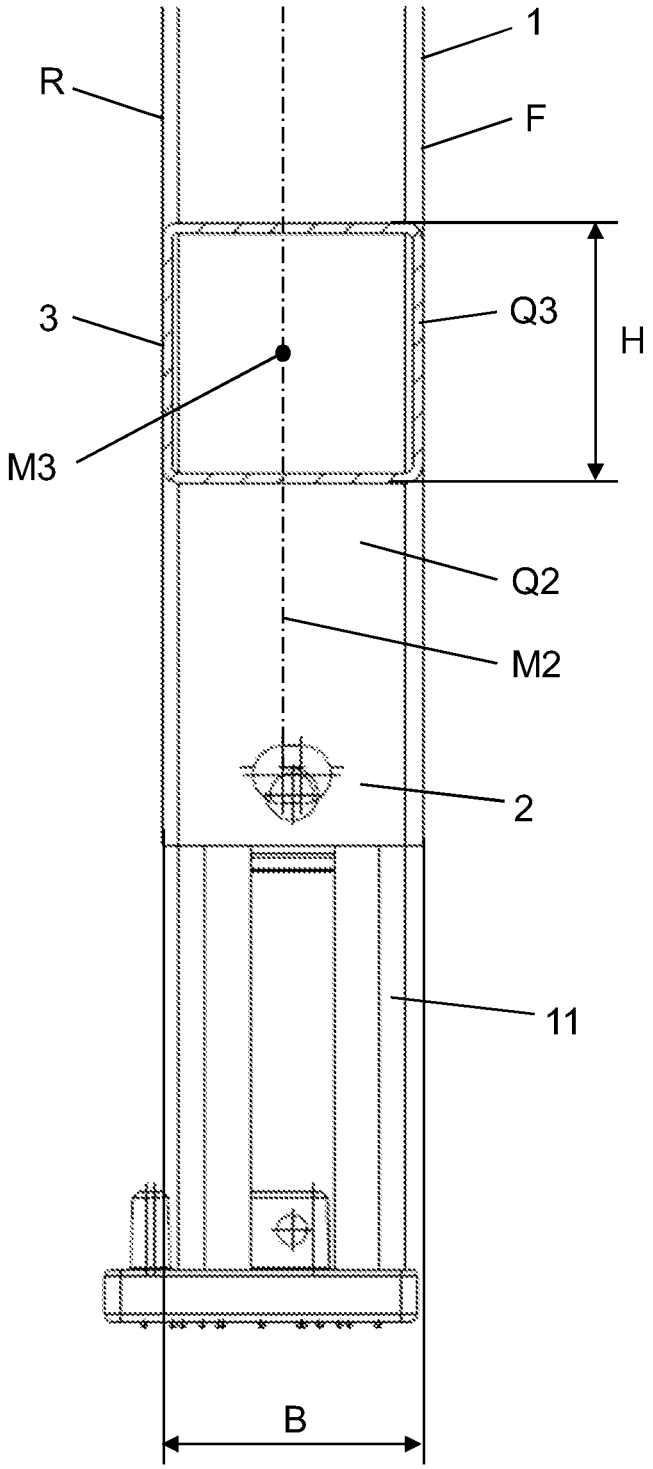
FIG. 6 shows a sectional view along the line of intersection VI-VI in FIG. 3.

FIG. 3 shows the sections from FIGS. 4 to 6. The sectional views in FIGS. 5 and 6 further illustrate how the profiles are identical to one another. In the embodiment shown, the cross-member 3 and the supports 2 are each configured as square tubes. The two square tubes are in this case the same as one another. In other words, the supports 2 and the cross-member 3 are provided by way of a tube profile, wherein the outer cross section and the inner cross section of the support 2 and the cross-member 3 are identical in each case, i.e., the profile is the same.

The sectional views in FIGS. 4 to 6 also show that the wall thickness W of the support 2 is identical to the wall thickness W of the cross-member 3. The wall thickness of the cross-member 3 and the supports 2 is typically in the region of from 1 and 8 mm, in particular between 1.5 and 3 mm.

The width B and height H of the cross-member cross section of the cross-member 3 and the support cross section Q2 of the support are in the region of from 30 mm to 50 mm respectively. In the embodiment shown, a square cross section is shown, i.e., the width B and the height H are in this case identical to one another.

As illustrated in FIGS. 1 and 3, the second cross-member 4 has at least one attachment element 5. In the embodiment shown, a plurality of attachment elements 5 are arranged. The attachment elements 5 can be configured in a variety of ways, for example as a threaded opening directly in the second cross-member 4, as openings in the second cross-member 4, as nuts behind an opening in the second cross-member 4, or as a separate attachment component behind an opening in the second cross-member 4. The attachment elements 5 are preferably threaded structures, into which the corresponding threaded rods can be inserted or screwed. As already mentioned, the cross-member 4 has a different cross-sectional shape.

In the embodiment shown, the cross-member 4 is a cross-member which is subjected to tension and the cross-member 3 is a cross-member subjected to compression. The differing configuration of the cross-members enables the latter to be optimally configured to the mechanical loads thereon.

The leading face 6 of the supports 2 define a front plane F and the trailing face 7 of the supports 2 define a rear plane R. The at least one cross-member 3, 4 is thus arranged in such a way that it lies between the front plane F and the rear plane R. In the case of the cross-member 3, the corresponding lateral portions of the cross-member 3 also lie in the front plane F and the rear plane R respectively due to the identical configuration of the supports 2.

Preferably, each of the supports is connected to a support foot 11, via which the mounting device stands on a floor, wherein the support foot is preferably configured so as to be displaceable relative to the support and lockable relative to the support.

LIST OF REFERENCE SIGNS

1 mounting device R rear plane
2 support B width
3 first cross-member H height
4 second cross-member W wall thickness
5 attachment element M2 central axis
6 leading face Q2 support cross section
7 trailing face M3 central axis
8 third cross-member Q3 cross-member cross section
9 apertures M4 central axis
10 connection point Q4 cross-member cross section
11 support foot
M8 central axis
F front plane Q8 cross-member cross section

The invention claimed is:

1. A mounting device for attaching at least one sanitary fixture, comprising two supports, which run at a distance from one another, each extends along a central axis and each has a support cross section, a first cross-member, which extends along a respective central axis, has a cross-member cross section, is securely connected to the supports and connects the supports to one another, and a second cross-member, which extends along a respective central axis, has a cross-member cross section, is securely connected to the supports and connects the supports to one another, wherein the second cross-member is arranged at a distance from the first cross-member and, when viewed in the installation position, above the first cross-member, and wherein the cross-member cross section of the first cross-member is identical to the support cross section, wherein the cross-member cross section of the second cross-member differs from the support cross section, and wherein the second cross-member comprises at least one attachment element, via which the sanitary fixture can be attached to the mounting device.

2. The mounting device as claimed in claim 1, wherein the first cross-member and support cross sections which are configured to be identical to one another are identical with regard to cross-sectional geometry and/or cross-sectional area.

3. The mounting device as claimed in claim 2, wherein an outer cross section of the supports and the first cross-member is in each case identical to the first cross-member and support cross sections which are configured to be identical to one another.

4. The mounting device as claimed in claim 3, wherein the outer cross section and/or an inner cross section of the supports and the first cross-member each has a rectangular shape.

5. The mounting device as claimed in claim 1, wherein an outer cross section of the supports and the first cross-member is in each case identical to the first cross-member and support cross sections which are configured to be identical to one another.

6. The mounting device as claimed in claim 5, wherein the outer cross section and/or an inner cross section of the supports and the first cross-member each has a rectangular shape.

7. The mounting device as claimed in claim 1, wherein the supports and the first cross-member are provided by way of a hollow profile, wherein an outer cross section and an inner cross section of the support and the first cross-member are identical in each case to the cross-member and support cross sections which are configured to be identical to one another.

8. The mounting device as claimed in claim 7, wherein the outer cross section and/or the inner cross section of the supports and the first cross-member each has a rectangular shape.

9. The mounting device as claimed in claim 1, wherein the support and the first cross-member with the cross-member and support cross sections which are configured to be identical to one another are provided by way of a square tube or a welded square tube.

10. The mounting device as claimed in claim 1, wherein the wall thickness of the first cross-member and the supports is between 1 and 8 mm.

11. The mounting device as claimed in claim 1, wherein the width and/or the height of the cross-member cross section of the first cross-member, and of the support cross section of each support is in the region of from 30 to 50 mm.

12. The mounting device as claimed in claim 1, wherein the leading face of the supports define a front plane, and wherein the trailing face of the supports define a rear plane, wherein the first cross-member is arranged in such a way as to lie between the front plane and the rear plane.

13. A method for manufacturing a mounting device for attaching at least one sanitary fixture wherein said mounting device comprises two supports, which run at a distance from one another, each extends along a respective central axis and each has a support cross section, a first cross-member, which extends along a respective central axis, has a cross-member cross section, is securely connected to the supports and connects the supports to one another, and a second cross-member, which extends along a respective central axis, has a cross-member cross section, is securely connected to the supports and connects the supports to one another, wherein the second cross-member being arranged at a distance from the first cross-member and, when viewed in the installation position, above the first cross-member, wherein the cross-member cross section of the first cross-member is identical to the support cross section, wherein the cross-member cross section of the second cross-member differs from the support cross section, and wherein the second cross-member comprises at least one attachment element, via which the sanitary fixture can be attached to the mounting device and wherein the supports and the cross-member with an identical support or cross-member cross section are manufactured by a metal-forming procedure and a subsequent welding procedure.

14. The method as claimed in claim 13, wherein, prior to the metal-forming procedure, a metal sheet is provided in the dimensions of the development of the profile about the central axis and the profile length for each of the supports and the first cross-member with an identical support or cross-member cross section.

15. The method as claimed in claim 14, wherein, prior to the metal-forming procedure, the metal sheet is provided with openings by way of a punching procedure.

16. The mounting device as claimed in claim 3, wherein the outer cross section and/or an inner cross section of the supports and the first cross-member each has a square shape.

17. The mounting device as claimed in claim 5, wherein the outer cross section and/or inner cross section of the supports and the first cross-member each has a square shape.

18. The mounting device as claimed in claim 7, wherein the outer cross section and/or inner cross section of the supports and the first cross-member each has a square shape.

19. The mounting device as claimed in claim 1, wherein the wall thickness of the first cross-member and the supports is between 1.5 and 3 mm.

20. The mounting device as claimed in claim 1, wherein the width and/or the height of the cross-member cross section of the first cross-member and of the support cross section of each support is between 35 and 45 mm.

* * * * *